United States Patent [19]

Parker

[11] Patent Number: 5,027,554

[45] Date of Patent: Jul. 2, 1991

[54] OVERSIZED GATE OR DOOR OPERATING SYSTEM

[75] Inventor: James Parker, Pacoima, Calif.

[73] Assignee: J&B Electronic Door Service, Inc., Pacoima, Calif.

[21] Appl. No.: 598,501

[22] Filed: Oct. 15, 1990

[51] Int. Cl.[5] ..... E05D 15/40

[52] U.S. Cl. ..... 49/206; 49/200

[58] Field of Search ..... 49/204, 203, 206, 200, 49/199

[56] References Cited

U.S. PATENT DOCUMENTS

| | | | |
|---|---|---|---|
| 2,173,684 | 9/1939 | Graham et al. | 49/206 |
| 2,195,875 | 4/1940 | Pixley | 49/206 |
| 2,314,634 | 3/1943 | Robinson | 49/206 |
| 2,539,200 | 1/1951 | Olsen | 49/206 |
| 2,552,752 | 5/1951 | Venditty | 49/206 |
| 2,569,614 | 10/1951 | Lewis et al. | 49/206 |
| 3,348,336 | 10/1967 | Hashagen | 49/200 |
| 3,921,251 | 11/1975 | Andresen | 49/203 X |

*Primary Examiner*—Philip C. Kannan

*Attorney, Agent, or Firm*—Wagner & Middlebrook

[57] ABSTRACT

A mechanism for opening and closing a large one piece rectangular overhead gate includes vertical jamb members on each side of the gate, horizontal track members located near the top of each side of the gate, track rollers fastened to the gate and carried on the track members, kicker wheel brackets attached to each jamb member each including a main pivot, an upper spring mounting member above the pivot, spring arm members fastened to said pivots and a kicker wheel mounted above the upper spring mounting member, a lower spring mounting member near the lower end of each jamb member, coil springs attached between upper and lower spring mounting members and an electric motor attached to the top of the gate to raise and lower the gate.

10 Claims, 3 Drawing Sheets

OVERSIZED GATE OR DOOR OPERATING SYSTEM

BACKGROUND OF THE INVENTION

Through the years, the need has grown for electrically operated gate and vehicle door systems to provide increased security and ready access by means of key operated or radio controlled opening and closing systems. In the case where sufficient real estate is available, a side rolling gate may be installed. However, it requires frontage of at least double the width of the gate opening. Often such space is not available, and it is essential that a retracting gate or door be installed.

Recently, the need for higher gates and doors has arisen since it is becoming a standard practice for higher passenger vehicles, such as wheel chair carrying vans be allowed entrance through gates. Where in the past, an 8'6" inch gate would be adequate for most passenger vehicles, gates as high as 10–11 feet must be in place and operate with the same degree of speed and safety as smaller gates.

Also, need has arisen in both industrial areas and apartment areas, particularly in Metropolitan regions, that a gate be of sufficient height to allow a full van or truck to enter with the gate closable behind the moving van or truck for unloading within the secure area.

At first observation, it would appear that the production of larger higher gates could be carried out merely following existing drawing design criteria for smaller gates. However, it is becoming clearer that the loading on larger gates cannot be solved merely by the use of larger components. As Larger, heavier hardware provided for the heavier load, difficulty was experienced in balancing the load throughout its cycle of movement. There is always a danger of failure of a component which could cause a catastrophic failure and injury or possible death of any individual under the gate or door. There is, therefore, a need for operating hardware which is capable of operating such large size gates or doors smoothly and safely, and which is not unduly difficult to install.

Applicant has found that in increasing the height of the gate or door as described above, it was necessary to increase the weight and size of many of the components. Even when this was done, there was no assurance that the door would operate smoothly. It is, therefore, an object of the present invention to provide a set of operating hardware for an oversized gate or door which will operate smoothly and reliably without undue stress or distortion of its components.

It is another object of the present invention to provide a set of operating hardware for an oversized door as described which is not unduly difficult or dangerous to install.

Other objects and advantages will become apparent from the following specification taken in connection with the accompanying drawings in which:

DESCRIPTION OF THE PREFERRED EMBODIMENT

Figure 1:
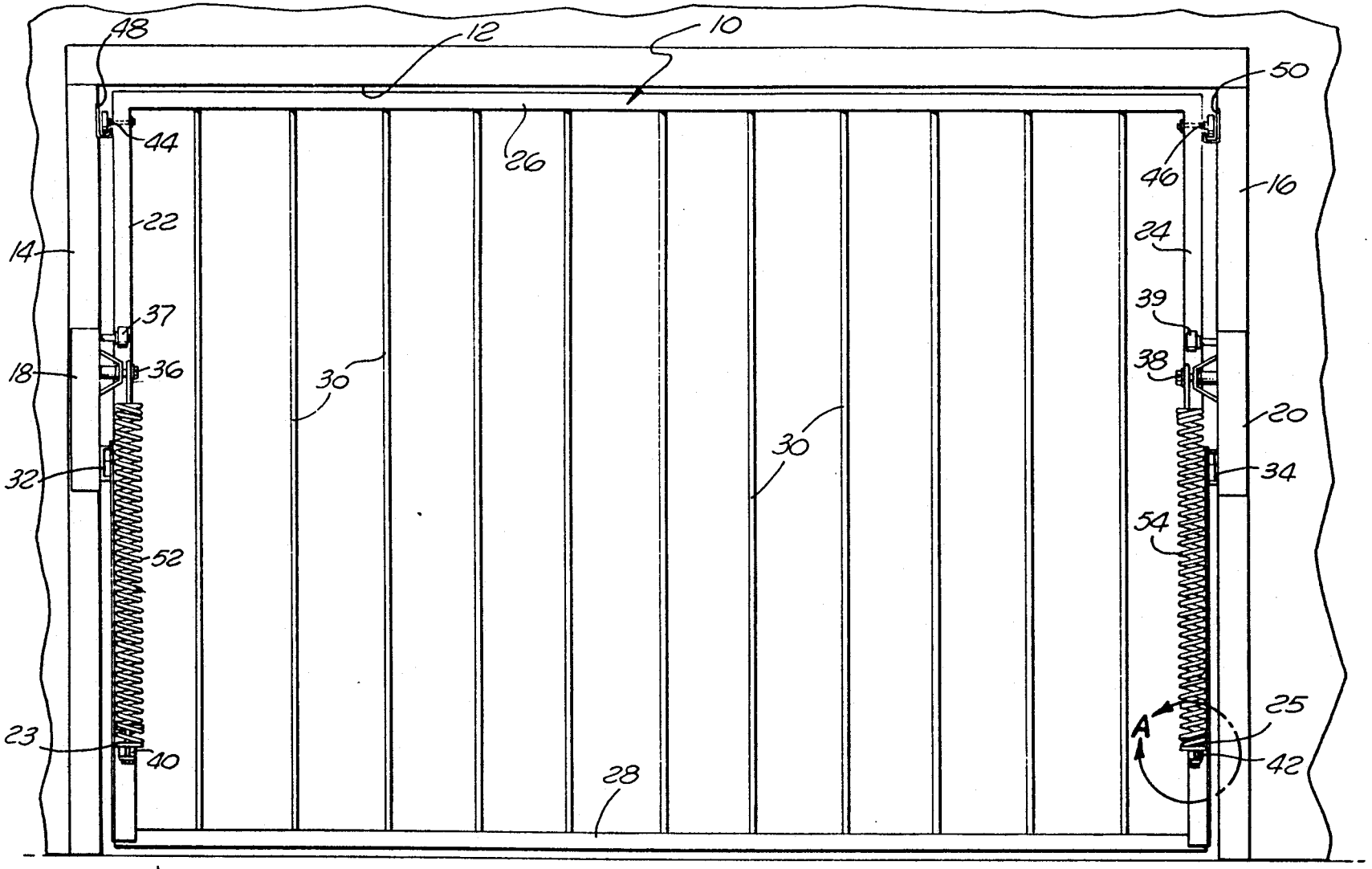
FIG. 1 is a front view of an oversized gate in closed position with my operating hardware installed.

Referring now to FIG. 1, a metal gate 10 of substantial size such as 12 feet wide by 9 feet high is mounted in an opening 12 between a pair of jamb members 14 and 16. A pair of kicker wheel brackets 18 and 20 are secured, as by welding, to jamb members 14 and 16, respectively. Gate 10 includes vertical side members 22 and 24, a horizontal top member 26 and a horizontal bottom member 28 with members 22,24, 26 and 28 welded into a rectangular frame. A plurality of vertical picket members 30 extend between the horizontal members. One or more horizontal or diagonal cross members may also be included if desired.

Kicker wheel brackets 18 and 20 carry main pivot members 32 and 34, respectively, upper spring supports 36 and 38, respectively, and kicker wheels 37 and 39 respectively. A pair of lower spring mounting brackets 40 and 42 are secured to side members 22 and 24 at or near their lowest points. Spring arms 23 and 25 are secured to brackets 40 and 42 and pivot around the main pivot members 36 and 38. Fastened near the tops of side members 14 and 16 are a pair of track rollers and support brackets 44 and 46. The track rollers 44 and 46 are carried on a pair of track members 48 and 50 which are welded to jamb members 14 and 16 and which have a "J" shaped cross-section within which its rollers move as the gate 10 is opened and closed. Since track members 48 and 50 extend a substantial distance in a plane normal to the plane of the drawing, they are supported by additional means (not shown) on the inside of the gate 10.

Figures 1A, 3:
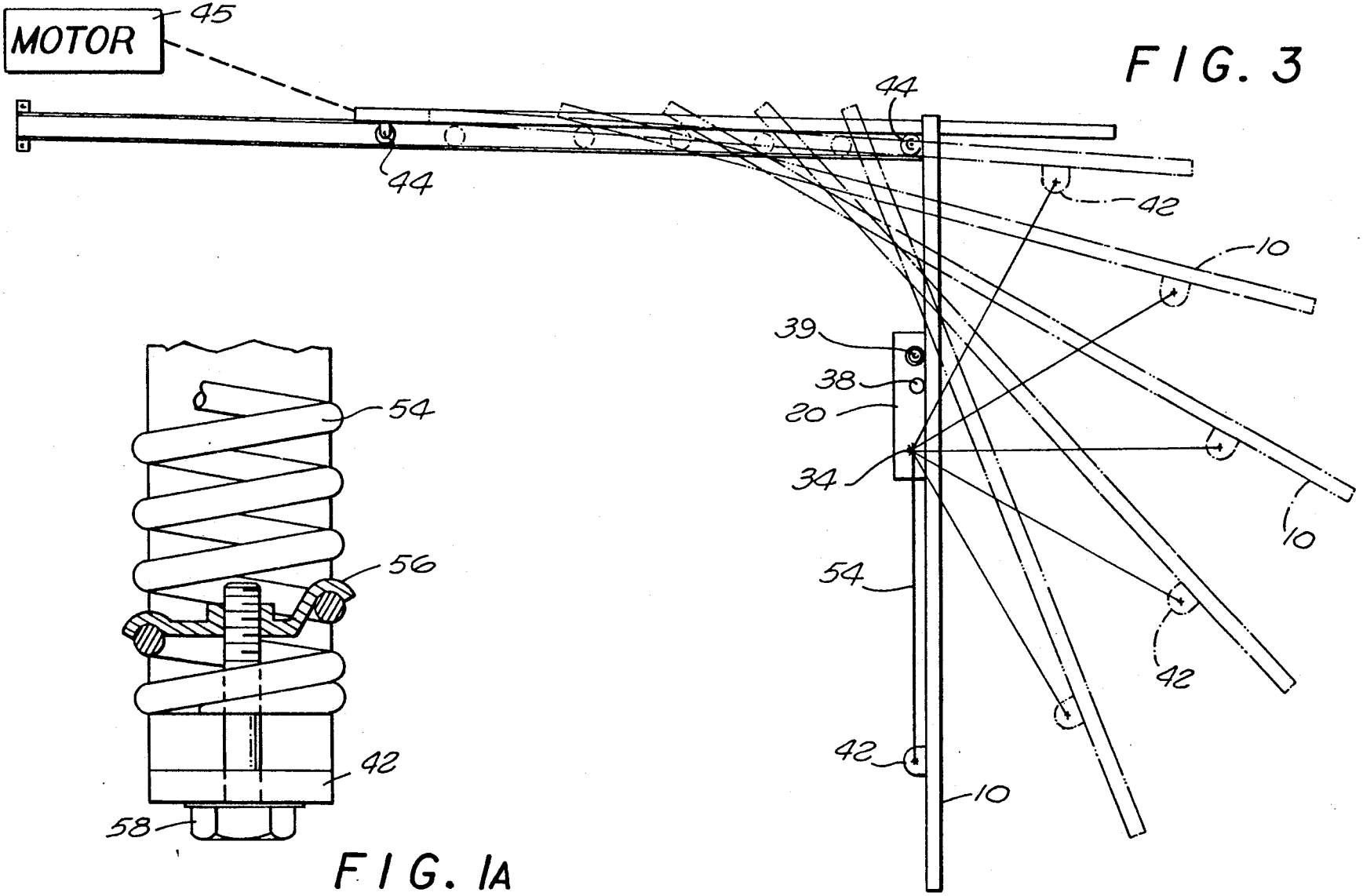
FIG. 1A is an enlarged fragmentary view, partly in section, of the encircled portion of FIG. 1 marked "A".
FIG. 3 is a motion drawing of the gate of FIGS. 1 and 2 with portions removed to clarify the operating cycle.

Stretched between upper spring support members 36 and 38 and lower spring mounting members 40 and 42 are a pair of comparatively large and heavy coil springs 52 and 54. Both ends of springs 52 and 54 are secured to their respective mounting brackets by means of spring mounting brackets which are interposed between the second and third coils from each end of each spring. FIG. 1A is an enlarged fragmentary view, partly in section, and showing the lower end of spring 54 with a spring mounting bracket 56 located between the second and third coils of the spring. Bracket 56 is essentially a heavy flat plate member having one end offset somewhat to compensate for the difference in axial location of opposite sides of the coils. Bracket 56 is, therefore, essentially normal to the axis of the spring. The brackets 56 at the lower ends of springs 52 and 54 are threadedly connected with a bolt 58 passing through the mounting members 40 and 42 which allows the tension in the springs 52 and 54 to be adjusted. The brackets 56 at the upper ends of the springs are arranged similarly but without the threaded adjustment means.

Figure 2:
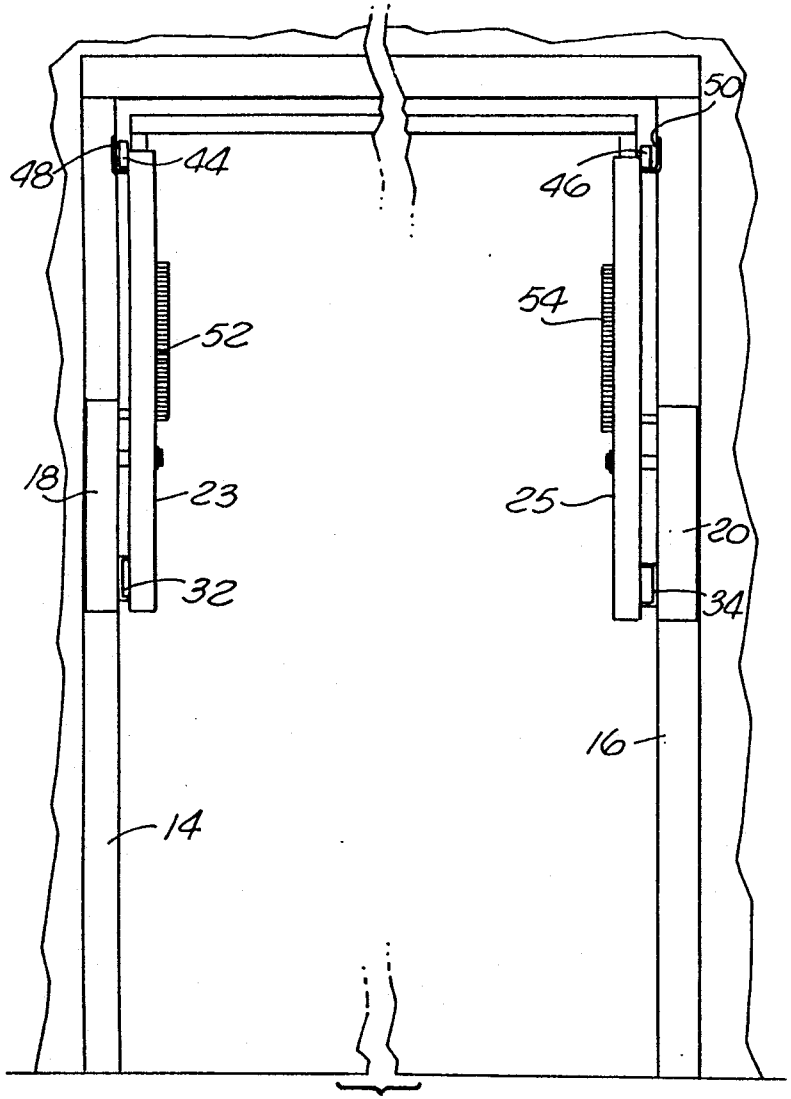
FIG. 2 is a front view of the gate of FIG. 1 with the gate in raised position.

FIG. 2 is a view from the front, of the gate 10 in raised position. Visible in this view are kicker wheel brackets 18 and 20 with main pivots 32 and 34 around which the spring arms 23 and 25 move as the door 10 is raised. It has been found particularly useful in installing the gate to have the kicker wheel brackets formed with the kicker wheel, the main pivots and the upper spring supports located in place as the kicker wheel brackets are welded to the jambs. The springs 52, 54 are now behind the arms and, since they pivot around the upper spring supports 36,38, they are considerably shortened. The "J" tracks 48 and 50 occupy the same position as in FIG. 1 but it will be recognized that the track rollers and support brackets 44 and 46 will have moved inwardly of the opening 12.

FIG. 3 is a diagrammatic view of the gate 10 as it would be seen from the side if stopped at several different positions. To clarify the showing, the jamb members, the nearest spring support bracket, and the springs have been eliminated. A reversible motor 45 is connected to the horizontal top member 26 of gate 10. One spring arm 54 is shown in several positions as a series of straight lines radiating from the main pivot 34, which is carried on kicker wheel bracket 20. The spring 54, which is not shown, extends between the lower spring support 42 to which spring arm 54 is attached and the upper spring support 38. By comparing the distance between upper spring support 38 and lower spring support 42 with the gate in various positions, it will be seen that the spring shortens progressively as the gate 10 is moved from closed to open position. The track roller and support bracket 44 is progressively moved along the track member 50 from a position directly above the upper spring support bracket 38 to a position inside the gate opening by slightly less than the height of the gate. A kicker wheel 39 mounted on bracket 20 is initially in contact with vertical side members 24 and becomes an initial pivot point around which the gate pivot as it is lifted. From FIG. 3, it appears that gate 10 is against kicker wheel 37 when fully closed. Subsequently, the arm 54 begins to lift the gate so that it no longer rides on the kicker wheel 37. For ease of installation and to assure accuracy in relative positioning of the main pivot 39, upper spring mount 38 and kicker wheel 39, it has been found to be useful to have these members all carried on the kicker wheel bracket 20.

In developing applicant's present gate design for taller size gates (9'-9'6" and higher) it was necessary to deal with the fact that the gate is substantially heavier than the 7 to 8 ft. gates presently in large volume use and the spring travel required was such that the springs usually used for the 7 to 8 ft. gates were inadequate, even if used in pairs on each side because the required travel exceeded their elastic limit, causing them to take a "set" which prevented them from returning to their original unloaded configuration. Applicant has, therefore, provided a spring which is significantly longer, has a larger diameter and heavier wire used to make the coils. This larger and heavier spring, when mounted as described, provides very smooth operation of the gate 10 and results in operation of the springs which is well within their design limits.

Figure 4:
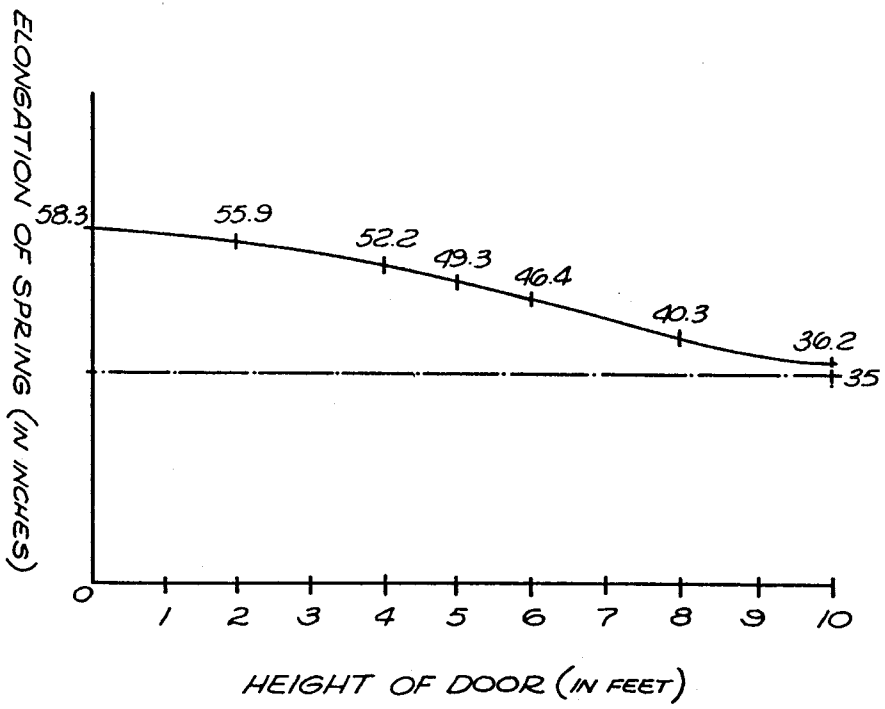
FIG. 4 is a graph showing spring extension vs. height of gate opening during the operating cycle of the gate.

The graph of FIG. 4 shows the elongation of the spring from its most extended position when the gate is closed to its least extended position when the gate is open. The overall pattern of reduction of extension during opening of the gate is essentially linear. During approximately the first 20% opening the pattern shows a slight non linearity but the remainder of the opening and closing cycle shows a progressive, essentially linear, diminution of the spring extension from this 20% point until the gate is fully opened.

While a single embodiment has been shown and described herein, those skilled in the art will be aware of modification and I do not desire to be limited other than by the appended claims, as interpreted by the doctrine of equivalents.

I claim:

1. A mechanism for opening and closing a large one piece rectangular overhead gate including vertical side members and horizontal top and bottom members spaced between said side members;

vertical jamb members, one on each side of the gate;

first and second essentially horizontal track members positioned slightly below its top of the gate;

first and second track rollers fastened to said gate near the tops of said vertical side members and carried on said track members;

a reversible electric motor and means connecting said motor with said top member such that when said motor is operated in one direction said top member is pulled toward said motor and when said motor is operated in the opposite direction, said top member is moved away from the said motor;

first and second kicker wheel brackets attached to said jamb members, each said bracket including means defining a main pivot point near the center of said vertical side member, an upper spring mounting means a significant distance above said main pivot point, spring arm members fastened to said kicker wheel brackets at said main pivot point and a kicker wheel and attachment means mounted on said kicker wheel bracket above said upper spring mounting means;

a lower pivot member attached to each of said vertical side members at a point below said main pivot points by approximately the length of said spring arm members are lower spring attachment means and said spring arm members being attached to each of said lower pivot members; and first and second coil springs attached on each side of said gate between said upper and lower spring attachment means, and variable tensioning means for adjusting the tension in said springs.

2. The combination as claimed in claim 1 wherein said spring arm includes an elongated member having an angled cross-section and a plate extending vertically to the long dimension of said elongated member and fastened to one end thereof, said plate including mounting means attached to said main pivot point spaced from said elongated member.

3. The combination as claimed in claim 1 wherein essentially flat spring mounting brackets are interposed between coils of said springs spaced at least two coils from each end, said brackets being offset on one end an amount sufficient to compensate for the difference in axial distance between opposite sides of the coils such that said brackets are carried in said coils essentially normal to the axis of said coil springs.

4. The combination as claimed in claim 3 wherein said variable tensioning means includes threaded means fastened to one of said spring brackets in each spring and to the adjacent spring attachment means for varying the tension of said springs.

5. The combination as claimed in claim 1 wherein said coil springs are extended to the maximum extend when said gate is closed, are shortened only slightly during the course of raising its gate approximately the first 20% of upward travel and shortened essentially linearly over the remainder of the raising cycle of said gate with the spring tension being at its lowest when said gate is fully raised.

6. The combination as claimed in claim 1 wherein during the initial part of the raising cycle of said gate, said vertical side members are in contact with and pivot around said kicker wheels and during the remaining part of said raising cycle, said vertical side members are raised above said kicker wheels by said spring arm members.

7. A mechanism for opening and closing a large one piece rectangular overhead gate having vertical side members and horizontal top and bottom members spaced between side members, including a pair of jamb members, one on each side of the gate;

track means positioned adjacent the top corners of the gate and track rollers fastened to said gate carried on said track means, electric motor means connected to said horizontal top member for raising and lowering said gate;

first and second kicker wheel brackets attached to said jamb members, each including a kicker wheel attached to said bracket, means defining a main pivot point and upper spring attachment means spaced a significant distance above said main pivot point, and a spring arm member fastened to each of said main pivot points;

a lower pivot member attached to each of said vertical side members at a point below said main pivot points by approximately the length of said spring arm members- and lower spring attachment means attached to each of said vertical side members; and first and second coil springs attached to said upper and lower spring attachment means and variable tensioning means for adjusting the tension in said springs including bolts threadedly engaged with said lower spring attachment means, said coil springs being extended the greatest distance when said gate is closed, are shortened only slightly during the course of raising the gate approximately the first 20% of its travel and shorten essentially linearly over the remaining part of the raising cycle of said gate with the spring extension being the least when said gate is fully raised.

8. The combination as claimed in claim 7 where said spring arm includes an elongated member having an angled cross-section and a plate extending vertically to the long dimension of said elongated member and fastened to one end thereof, said plate including mounting means attached to said main pivot point spaced from said elongated member.

9. The combination as claimed in claim 7 wherein essentially flat spring mounting brackets are interposed between coils of said springs spaced at least two coils from each end, said brackets being offset on one end an amount sufficient to compensate for the difference in axial distance between opposite sides of the coils such that said brackets are carried in said coils essentially normal to the axis of said coil springs.

10. The combination as claimed in claim 9 wherein said variable tensioning means includes threaded means fastened to one of said spring brackets in each spring and to the adjacent spring attachment means for varying the tension of said springs.

* * * * *